US007896972B2

(12) United States Patent
Berends et al.

(10) Patent No.: US 7,896,972 B2
(45) Date of Patent: Mar. 1, 2011

(54) DISHWASHER AND METHOD FOR CARRYING OUT A CLEANING CYCLE IN THE DISHWASHER

(75) Inventors: Erik Berends, Bielefeld (DE); Markus Druecker, Guetersloh (DE); Dirk Wegener, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1268 days.

(21) Appl. No.: 11/424,426

(22) Filed: Jun. 15, 2006

(65) Prior Publication Data

US 2006/0283482 A1 Dec. 21, 2006

(30) Foreign Application Priority Data

Jun. 17, 2005 (DE) ..... 10 2005 028 449

(51) Int. Cl.
*B08B 7/04* (2006.01)
*B08B 3/04* (2006.01)

(52) U.S. Cl. ..... 134/18; 134/25.2; 134/57 DL; 134/58 DL

(58) Field of Classification Search ..... 134/18, 134/56 R–58 DL
See application file for complete search history.

(56) References Cited

U.S. PATENT DOCUMENTS 5,881,746 A * 3/1999 Buser et al. ..... 134/58 D
2004/0163684 A1 * 8/2004 Hapke ..... 134/57 DL

FOREIGN PATENT DOCUMENTS

DE 3922754 * 1/1991
DE 4443849 5/1996
DE 19960814 6/2001
EP 0 687 439 * 12/1995
EP 0 687 439 A1 12/1995

OTHER PUBLICATIONS

European Search Report for European Patent Application No. EP1733675 mailed on Aug. 16, 2007.

* cited by examiner

*Primary Examiner* — Michael Kornakov
*Assistant Examiner* — Natasha Campbell
(74) *Attorney, Agent, or Firm* — Leydig, Voit & Mayer, Ltd.

(57) ABSTRACT

A dishwasher includes a tub, a hinged door for closing the tub, a sealing gasket disposed between the tub and the door, a device control unit, a closing plate connected to the tub and movable by a motor, a latching element disposed on the door, and a closing tab disposed on the closing plate for engaging with the latching element for closing the door and enabling the device control unit to partially open the door. The closing plate is movable into first and second positions to bring the door into respective first and second partially open positions with respective first and second gap widths. The second gap width is larger than the first gap width.

8 Claims, 3 Drawing Sheets

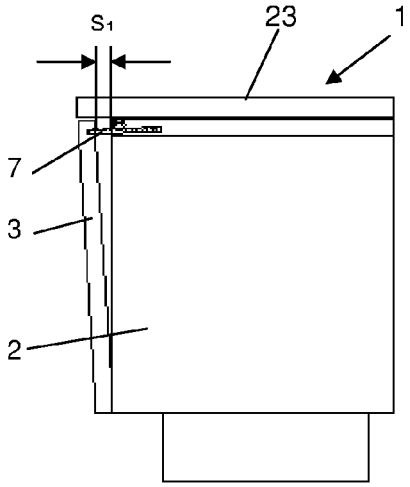
Fig. 3a
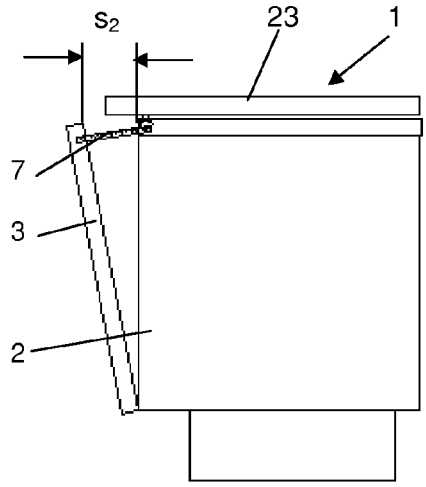
Fig. 3b
Fig. 3
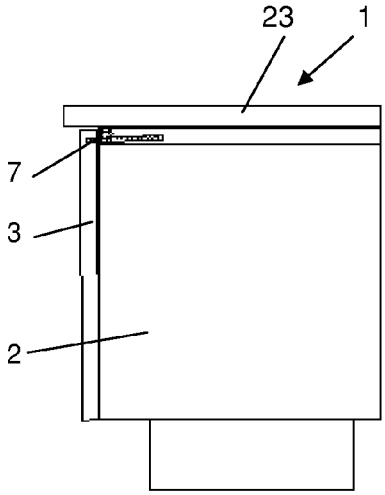
Fig. 3c
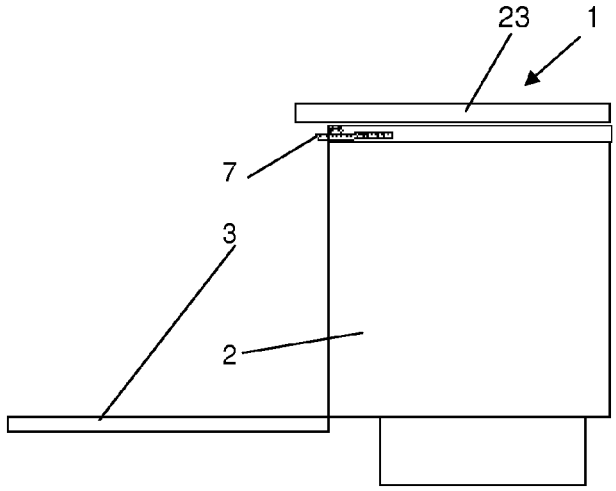
Fig. 3d

DISHWASHER AND METHOD FOR CARRYING OUT A CLEANING CYCLE IN THE DISHWASHER

Priority is claimed to German patent application DE 10 2005 028 449.3, filed Jun. 17, 2005, the entire subject matter of which is hereby incorporated by reference herein.

The invention relates to a dishwasher having a tub, which can be closed by a hinged door that is fitted with a sealing gasket between the tub and the door, and having a device control unit whereby, for purposes of closing, a latching element arranged on the door engages with a closing tab arranged on the dishwasher tub, and whereby, in order for the device control unit to partially open the door, the closing tab is arranged on a closing plate that can be moved by a motor. The invention also relates to a method to run a cleaning cycle in such a dishwasher.

BACKGROUND

U.S. Pat. No. 5,881,746, describes a dishwasher in which the closing tab is arranged on a closing plate and the closing plate is mounted eccentrically on a motor. As a result, the dishwasher tub can be partially opened automatically after the cleaning and rinsing cycles, so that the residual moisture escapes by natural convection. Even though the opening mechanism described in this publication accounts for an improvement of the drying procedure, there are still drawbacks due to the fact that the opening mechanism described here cannot bring about the necessary degree of opening. Such a degree of opening is required especially when the dishwasher has been installed in a custom kitchen and its upper section is covered by a countertop. In the embodiment shown in U.S. Pat. No. 5,881,746, the hot air laden with moisture condenses on the underside of the cold countertop, which can damage it.

Another drawback can be seen in the fact that the door can only be closed by bringing considerable pressure to bear or by slamming the door since this pushing or slamming force has to be exerted against the resilience of the door sealing gasket. Therefore, weak persons often have a difficult time closing the door.

European patent application EP 0 687 439 A1 discloses a dishwasher in which the door is likewise partially opened by means of closing tab that is moved by a motor after the cleaning and drying cycles have ended. Here, the closing tab remains in this slightly open position after the end of the cycle. As a result, it should be easier for users to close the door after unloading the dishwasher since then the closing tab is moved into its end position by the motor. A disadvantage of this solution is that the opening gap has to be large during the assistance drying procedure (see above), as a result of which the closing tab protrudes far into the room. In this position, the closing tab constitutes an injury hazard, in addition to which it can easily be damaged.

SUMMARY OF THE INVENTION

It is an object of the present invention to provide a dishwasher in which it is possible to open and close the door in a controlled manner. It is another, alternative, object of the present invention to provide a method to run a cleaning cycle of a dishwasher in which it is possible to open and close the door in a controlled manner.

The present invention provides a dishwasher including: a tub; a hinged door configured to close the tub; a sealing gasket disposed between the tub and the door; a device control unit;

a closing plate connected to the tub and movable by a motor; a latching element disposed on the door; and a closing tab disposed on the closing plate and configured to engage with the latching element so as to close the door and so as to enable the device control unit to partially open the door. The closing plate is movable into first and second positions so as to bring the door into respective first and second partially open positions with respective first and second gap widths, the second gap width being larger than the first gap width.

The present invention also provides a method of carrying out a cleaning cycle in a dishwasher, the dishwasher including: a tub; a hinged door configured to close the tub; a sealing gasket disposed between the tub and the door; a device control unit; a closing plate connected to the tub and movable by a motor; a latching element disposed on the door; and a closing tab disposed on the closing plate and configured to engage with the latching element so as to close the door and so as to enable the device control unit to partially open the door. The closing plate is movable into first and second positions so as to bring the door into respective first and second partially open positions with respective first and second gap widths, the second gap width being larger than the first gap width. The method includes: actuating the motor by the device control unit so as to move the closing plate into the second position at the end of the cycle; and actuating the motor by the device control unit so as to move the closing plate into the first position when the latching element is not engaged with the closing tab.

The fact that the closing plate can be automatically moved into two different open positions allows, on the one hand, the opening of a gap that is sufficient for the drying since vapor can escape from the inside of the dishwasher tub and can be released into the ambient air while, on the other hand, the closing plate can be returned from this bothersome position and can nevertheless be put into a position in which the door can easily be latched.

To this end, it is advantageous for the first gap width to be dimensioned in such a way that it is the same as or slightly greater than the thickness of the sealing gasket, so that it amounts to approximately one centimeter. The second gap width should be dimensioned in such a way that, when the door has been opened with such a gap, its upper inner edge protrudes beyond the cover or countertop located on top of the dishwasher, so that is amounts to approximately 10 centimeters.

Configuring the dishwasher according to the invention allows several advantageous methods to run a cleaning cycle.

For instance, in order to assist the drying operation, the device control unit can actuate the motor to move the closing plate into the second open position at the end of the cycle. This is particularly advantageous if there is still quite a lot of moisture on the dishes present in the dishwasher tub at the end of the cycle. A criterion for this can be the cycle selected by the user, for example, a cycle for washing glassware, a cycle for cleaning plastic utensils or an automatic cycle. As an alternative, values that reflect the degree of drying can be ascertained by sensors. Since the door is opened wide, it is avoided that the dishes become moist again and their drying is accelerated. Subsequently, it is easier for the user to close the door in that the device control unit actuates the motor to move the closing plate into the first open position after the latching element has been released. In order to perform this operation, the device control unit senses the actuation of the latching element for the opening and/or closing procedure. Due to the retracted position of the closing plate, the user does not need to apply pressure against the sealing gasket when closing the door and nevertheless the latching element securely engages with the closing tab. After the latching element has engaged, it is then advantageous for the device control unit to actuate the motor in order to move the closing plate into the closed position in which the door closes with the sealing gasket between the tub and the door.

Another advantageous method is characterized in that, when a machine malfunction or operating malfunction is detected, the device control unit actuates the motor to move the closing plate into the second open position. Such an automatic opening of the door in cases of malfunction is particularly advantageous for so-called fully integrated dishwashers since these have the operating panel and the appertaining displays on the upper edge of the door, so that they can only be seen when the door is open. In order to simplify the operating procedure once the machine malfunction or operating malfunction has been detected and remedied, the control unit device can actuate the motor to move the closing plate into the first open position when the latching element is released or into the closed position when the latching element is engaged.

In order to simplify the movement of the closing plate into its various positions, it is advantageous for the device control unit to switch off the motor by means of sensors associated with the two opening positions and with the closed position so as to precisely determine the position.

BRIEF DESCRIPTION OF THE DRAWINGS

An embodiment of the invention is depicted purely schematically in the drawings and will be described in greater detail below. The following are shown:

FIG. 1 shows the closing mechanism of a dishwasher 1 structured according to the invention, with its cover removed, its operating panel removed and its outside door panel removed, whereby

FIG. 3 shows the door in various positions, whereby

FIG. 3*a* shows the door with the closing plate 7 in the first open position, FIG. 3*b* shows the door with the closing plate 7 in the second open position, FIG. 3*c* shows the closed door 3 and FIG. 3*d* shows the completely opened door 3.

DETAILED DESCRIPTION

Figure 1A:
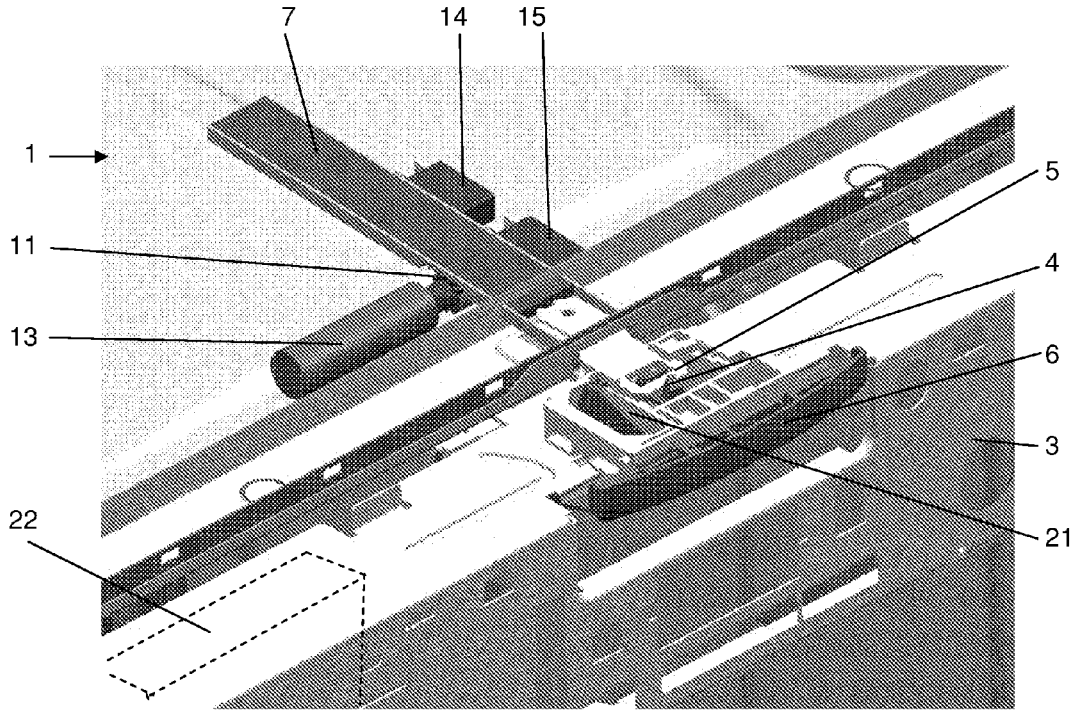
FIG. 1*a* shows the closed door 3 and FIG. 1*b* shows the door 3 opened with a gap.
Figure 1B:
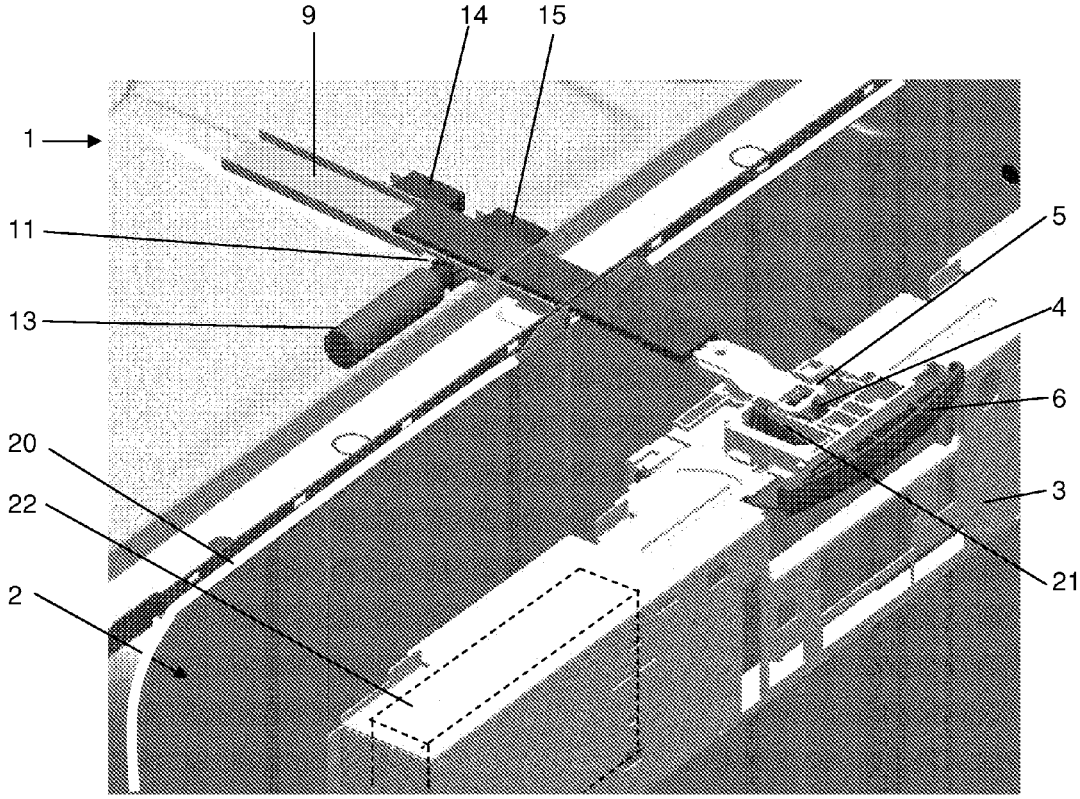

FIGS. 1*a* and 1*b* show a dishwasher 1 where, for the sake of clarity, the closing mechanism of the cover, the operating panel and the outside door panel have all been removed. The dishwasher 1 has a dishwasher tub 2 on which a door 3 is arranged so as to be hinged and to close the dishwasher tub 2. In order to prevent the washing liquid from leaking from the dishwasher tub 2, the latter is provided with an encircling sealing gasket 20. For purposes of keeping the door in the closed position, a forked latching element 4 is arranged on the door, said element being mounted so as to rotate in a known manner and, in its latching position, it engages with a closing tab 5 arranged on the dishwasher tub 2. In order to open the door, a handle 6 is pushed upwards, causing the latching element 4 to rotate by means of a mechanism into a position in which it is no longer held by the closing tab 5. The latching element 4 interacts with a switch 21 by means of which the device control unit 22 (indicated by the broken line) senses the actuation of the latching element 4 for the opening and/or closing operation, thus detecting the open state as well as the closed state. In order to now be able to partially open the door 3 as a function of the cycle without actuating the handle 6, the closing tab 5 is affixed to a closing plate 7 that can be moved linearly about 10 cm by the motor in the opening direction of the door 3. The motor is switched on via the device control unit 22 as a function of the cycle or of the state.

Figure 2:
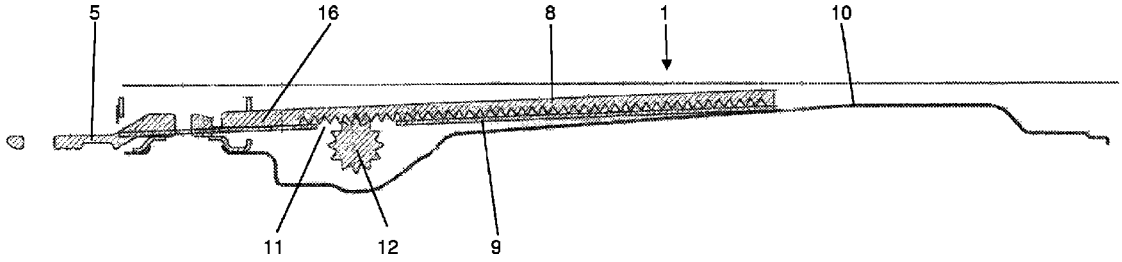
FIG. 2 shows the closing plate 7 in a sectional side view.

FIG. 2 shows the closing plate 7 and its drive in detail, depicting a sectional side view of a toothed rack 8 used as a closing plate 7 onto whose end the closing tab 5 is arranged in the form of a lug. Here, the toothed rack 8 is arranged in a guide channel 9 above the dishwasher tub 2, whereby this guide channel 9 is affixed on the upper side wall 10 of the dishwasher tub 2 so as to be slightly slanted. The guide channel 9 is provided with an opening 11 for a pinion 12. This opening 11 also forms the area where the pinion 12 meshes with the toothed rack 8. The pinion 12 is turned by a tubular motor 13, optionally with an integrated gear installed between the pinion 12 and the motor 13. In this context, position switches 14 and 15 (see FIGS. 1*a*, 1*b*) are arranged next to the guide channel, said switches indicating to the device control unit 22 when certain positions of the toothed rack 8 have been reached. Alternatively, it is also conceivable to have linear or rotary potentiometers or else optical sensors in order to precisely determine the position of the toothed rack 8. The closing of the door 3 is sensed by the rear position switch 14. The front position switch 15 interacts with two cams at a distance from each other on the toothed rack 8, so that said cams can be moved by the device control unit 22 employing the tubular motor 13 into two different open positions, as depicted in FIGS. 3*a* and 3*b*. The first open position (FIG. 3*a*) is characterized by a small gap width $s_1$ measuring about 1 cm and dimensioned in such a way that it is the same as or slightly greater than the thickness of the sealing gasket 20. The second open position (FIG. 3*b*) is characterized by a large gap width $s_2$ of approximately 10 cm and is thus dimensioned in such a way that, when the door 3 has been opened with such a gap, its upper inner edge protrudes beyond a cover 23 or countertop located on top of the dishwasher. The other figures show the dishwasher when the door 3 is closed (FIG. 3*c*) and when the door 3 is completely open (FIG. 3*d*).

The mode of functioning of the above-mentioned arrangement will be described below:

At the end of the cycle, the motor 13 moves the closing plate 7 into the second open position (FIG. 3*b*) so that the door 3 is opened by a gap $s_2$ of approximately 10 cm for purposes of assisting the drying procedure. The motor 13 needs about 10 seconds to do this. The drying assistance procedure can be permanently selected, it can be carried out only when certain cycles are selected or else it can be performed as a function of a value ascertained by sensors that reflects the degree of drying of the dishes contained in the dishwasher tub 2 at the end of the cycle. The amount and type of loading, the rate of increase of the temperature and the ambient conditions such as the temperature at the installation place—all detected by sensors—can serve as a measure of the degree of drying. The release of the latching element 4—from the position where the door 3 is open with the gap $s_2$ after the end of the cycle as well as from the closed position while the cycle is running or after a cycle that does not require the drying assistance procedure—is detected by the device control unit 22 through the opening of the switch 21. As soon as the door 3 has been unlatched, the device control unit 22 actuates the motor 13 to move the closing plate 7 into the first open position (FIG. 3*d*). When the door 3 is latched once again, it remains open with the gap $s_1$ (FIG. 3*a*) until the latching element 4 has engaged with the closing tab 5 and the switch 21 has closed. As a result, the door 3 is not yet in contact with the sealing gasket 20 and the user does not have to exert any force in order to push them together. Once the device control unit 22 has detected the end of the latching operation, it actuates the motor 13 to move the closing bar 7 into the closed position (FIG. 3*c*) in which the door closes the dishwasher tub 2 with the sealing gasket 20 between the door and the tub.

Another application case involving opening by a gap is realized when the device control unit 22 detects a machine malfunction or operating malfunction that prevents proper completion of the cycle. Thus, for instance, a feed tap might still be closed or a dispenser for rinse aid or for recharging dishwasher salt might be empty. In this case, the motor 13 moves the closing plate 7 into the second open position and the door is open in a clearly visible manner with the large gap $s_2$. Such an opening of the door with a gap is particularly advantageous for so-called fully integrated dishwashers (not shown here) since the user can see the operating panel on the upper edge of the door and can thus notice the warning symbols that are displayed there. Once the machine malfunction or operating malfunction has been remedied by the user or by a customer-service technician, the device control unit 22 recognizes this and actuates the motor 13 to subsequently move the closing plate 7 into the first open position if the latching element 4 is released, or into the closed position if the latching element 4 is engaged.

What is claimed is:

1. A method of carrying out a cleaning cycle in a dishwasher, the dishwasher including:

a tub;

a hinged door configured to close the tub;

a sealing gasket disposed between the tub and the door;

a device control unit;

a closing plate connected to the tub and movable by a motor;

a latching element disposed on the door; and a closing tab disposed on the closing plate and configured to engage with the latching element so as to close the door and so as to enable the device control unit to partially open the door;

the closing plate being movable into first and second positions so as to bring the door into respective first and second partially open positions with respective first and second gap widths, the second gap width being larger than the first gap width;

the method comprising:

actuating the motor by the device control unit so as to move the closing plate into the second position at the end of the cycle; and actuating the motor by the device control unit so as to move the closing plate into the first position when the latching element is not engaged with the closing tab.

2. The method as recited in claim 1 wherein actuating the motor by the device control unit so as to move the closing plate into the second position is performed as a function of a selected dishwashing cycle.

3. The method as recited in claim 1 wherein actuating the motor by the device control unit so as to move the closing plate into the second position is performed as a function of a degree of drying, at the end of the cycle, of dishes disposed in the tub.

4. The method as recited in claim 3 wherein the degree of drying is sensed by at least one sensor.

5. The method as recited in claim 1 further comprising actuating the motor by the device control unit when the latching element is engaged with the closing tab so as to move the closing plate into a third position so as to close the door.

6. The method as recited in claim 1 further comprising actuating the motor by the device control unit when a machine or operating malfunction occurs so as to move the closing plate into the second position.

7. The method as recited in claim 6 further comprising:

recognizing, by the device control unit, when the machine or operating malfunction has been remedied; and then actuating the motor by the device control unit so as to move the closing plate into the first position when the latching element is not engaged with the closing tab or move the closing plate into a third position so as to close the door when the latching element is engaged with the closing tab.

8. The method as recited in claim 5 further comprising switching off the motor by the device control unit using at least one sensor associated with the first, second and third positions of the closing plate.

* * * * *